US010830553B2

(12) United States Patent
Egerdee et al.

(10) Patent No.: US 10,830,553 B2
(45) Date of Patent: Nov. 10, 2020

(54) CROSSBOW WITH DETACHABLE LIMB ASSEMBLY

(71) Applicant: Excalibur Crossbow, Inc., Kitchener (CA)

(72) Inventors: Kyle William Egerdee, Fergus (CA); Stephen Donald Langdon, Arthur (CA)

(73) Assignee: EXCALIBUR CROSSBOW, INC., Kitchener (CA)

( * ) Notice: Subject to any disclaimer, the term of this patent is extended or adjusted under 35 U.S.C. 154(b) by 0 days.

(21) Appl. No.: 16/224,764

(22) Filed: Dec. 18, 2018

(65) Prior Publication Data

US 2020/0191518 A1 Jun. 18, 2020

(51) Int. Cl.
*F41B 5/12* (2006.01)
*F41B 5/14* (2006.01)

(52) U.S. Cl.
CPC ..... *F41B 5/1403* (2013.01); *F41B 5/12* (2013.01)

(58) Field of Classification Search
CPC ..... F41B 5/1403; F41B 5/12
USPC ..... 124/25, 26, 31
See application file for complete search history.

(56) References Cited

U.S. PATENT DOCUMENTS

| | | | | |
|---|---|---|---|---|
| 5,522,373 | A | 6/1996 | Barnett | |
| 5,553,596 | A * | 9/1996 | Bednar | F41B 5/12 124/25 |
| 8,042,530 | B2 | 10/2011 | Barnett | |
| 9,121,659 | B1 | 9/2015 | Chang | |
| 9,689,639 | B1 | 6/2017 | Liu | |
| 10,139,190 | B1 | 11/2018 | Trpkovski | |
| 10,267,592 | B2 | 4/2019 | Bartels | |
| 10,520,273 | B2 | 12/2019 | Bartels | |
| 10,520,274 | B2 | 12/2019 | Bartels | |

FOREIGN PATENT DOCUMENTS

| | | |
|---|---|---|
| GB | 2 285 587 | 10/1997 |

* cited by examiner

*Primary Examiner* — Vishu K Mendiratta
(74) *Attorney, Agent, or Firm* — David S. Alavi

(57) ABSTRACT

A crossbow includes a rail assembly and a limb assembly that can be assembled together and disassembled from one another. A release member is rigidly attached to one assembly and a retention member is attached to the other assembly. When the crossbow is assembled the release member is in a retained position; when the crossbow is disassembled the release member is removed from its retained position. In a release position the retention member permits movement of the release member into or out of the retained position; in a retention position the retention member prevents movement of the release member out of the retained position. The release and/or retention members can be adjusted to alter the force urging together the rail and limb assemblies. The retention member can be moved between the release and retention positions without using any tool.

21 Claims, 12 Drawing Sheets

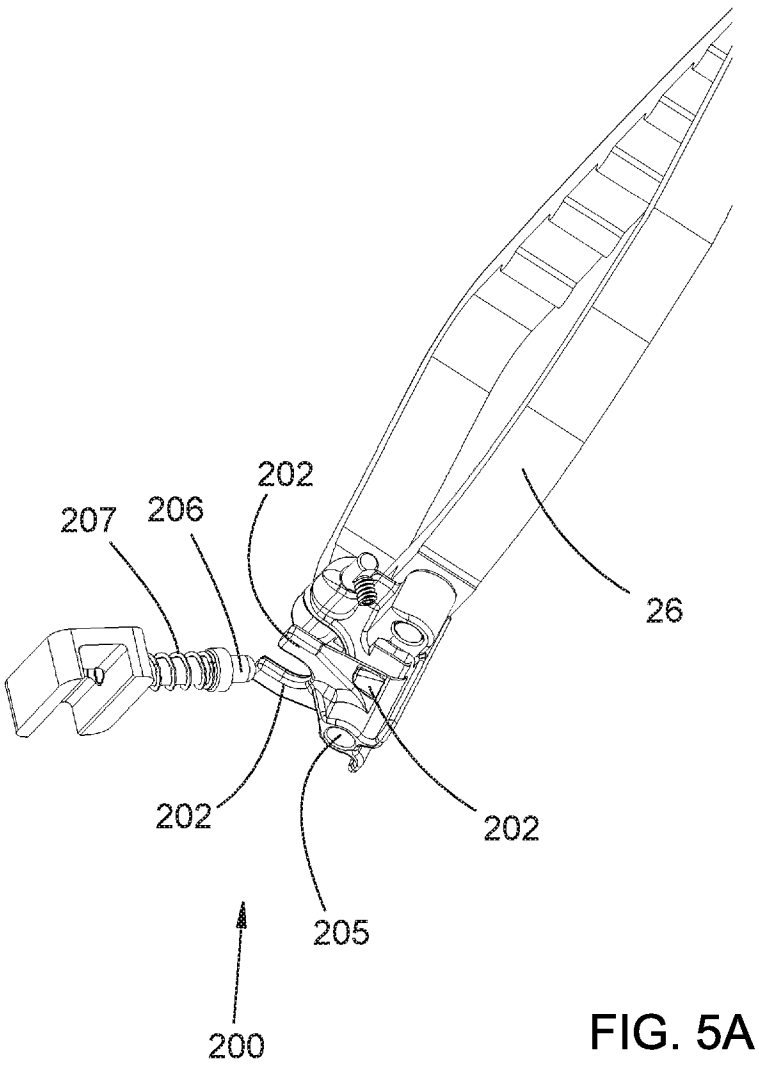
FIG. 5A
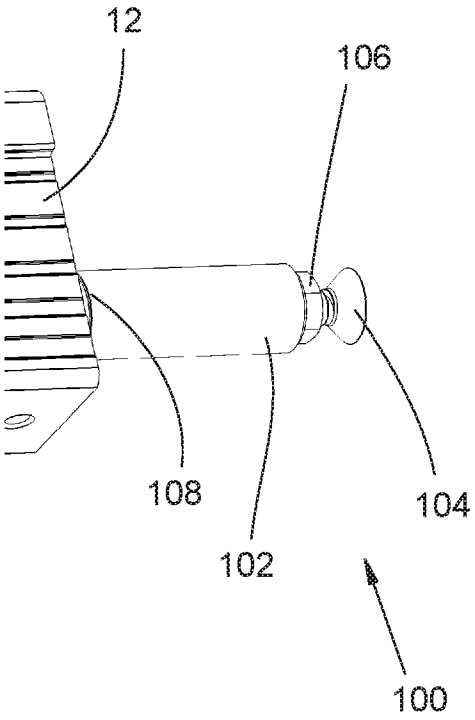

CROSSBOW WITH DETACHABLE LIMB ASSEMBLY

FIELD OF THE INVENTION

The field of the present invention relates to crossbows. In particular, disclosed herein are a crossbow with a detachable limb assembly, and methods for assembling, disassembling, and adjusting the crossbow.

BACKGROUND

A crossbow consists generally of a rail assembly arranged generally longitudinally (i.e., along the direction a bolt is to be shot) and a pair of flexible limbs extending generally transversely from a forward portion of the rail assembly. A transverse bowstring is connected to the limbs near their distal ends, directly (e.g., as in a recurve bow) or indirectly (e.g., via a pin, axle, or pully assembly, as in a compound bow). The rail assembly (also sometimes referred to as a mainframe or barrel) typically includes, in addition to a rail, a rearward stock portion and a trigger assembly, and often also includes a stirrup attached at its forward end, a crank or other draw mechanism, one or more safety mechanisms, one or more mounting members for a sight, scope, quiver, or other accessory, and so forth. The pair of limbs typically are part of a limb assembly (also sometimes referred to as a prod or prod assembly) that also includes a riser attached to a forward portion of the rail assembly, with the limbs in turn attached to the riser and the bowstring extending between the limb tips over the rail assembly. To shoot a bolt, the bolt is placed on top of the rail after drawing the crossbow, and triggering the crossbow to release the drawn bowstring causes the bolt to be launched from the crossbow.

The general arrangement of a crossbow, with the rail assembly and limb assemblies being arranged perpendicular to each other, makes the crossbow bulky and unwieldly to transport or store. Consequently, crossbows have been made available that have a limb assembly that is detachable from the rail assembly, enabling more compact storage and easier transport of the crossbow. Several examples of crossbows having a limb assembly detachable from a rail assembly are described in:

- U.S. Pat. No. 5,522,373 entitled "Cross bow" issued Jun. 4, 1996 to Barnett;
- U.S. Pat. No. 8,042,530 entitled "Crossbow with removable prod" issued Oct. 25, 2011 to Barnett;
- U.S. Pat. No. 9,121,659 entitled "Crossbow assembly" issued Sep. 1, 2015 to Chang;
- U.S. Pat. No. 9,689,639 entitled "Connection device for connecting limb to barrel of crossbow" issued Jun. 27, 2017 to Liu; and
- U.S. Pat. No. 10,139,190 entitled "Crossbow with take-apart stock" issued Nov. 27, 2018 to Trpkovski.

SUMMARY

An inventive crossbow comprises a rail assembly, a limb assembly, a retention member movable between a retention position and a release position, and a release member. The rail assembly includes a longitudinal rail and a rearward stock portion, and the limb assembly includes a central riser and a pair of bow limbs attached to and extending transversely from opposite sides of the riser. The release member is either (i) substantially rigidly attached to a forward portion of the rail from which it extends forward, in which case the retention member is attached to the riser, or (ii) substantially rigidly attached to the riser from which it extends rearward, in which case the retention member is attached to a forward portion of the rail. With the release member in a retained position, the riser is positioned against the forward portion of the rail so that the rail and limb assemblies of the crossbow are in an assembled arrangement; with the release member removed from the retained position, the riser is separated from the rail so that the rail and limb assemblies of the crossbow are in a disassembled arrangement. With the retention member in the release position, the release member is movable into the retained position and removable from the retained position, thereby enabling assembly and disassembly, respectively, of the crossbow. With the release member in the retained position and the retention member in the retention position, engagement of the retention member and the release member (i) prevents removal of the release member from the retained position thereby preventing disassembly of the crossbow, and (ii) urges the riser and the forward portion of the rail against each other. One or both of the release member or the retention member are arranged so as to enable adjustment of force with which engagement of the retention member and the release member urges against each other the riser and the forward portion of the rail. With the release member in the retained position and the rail and limb assemblies of the crossbow in the assembled arrangement, the retention member is movable between the release and retention positions without using any tool.

Objects and advantages pertaining to crossbows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 5A is an oblique view, with the riser and limbs omitted for clarity, of an example inventive crossbow in a disassembled arrangement.

The embodiments depicted are shown only schematically; all features may not be shown in full detail or in proper proportion, certain features or structures may be exaggerated relative to others for clarity, and the drawings should not be regarded as being to scale. The embodiments shown are only examples and should not be construed as limiting the scope of the present disclosure or appended claims.

DETAILED DESCRIPTION OF EMBODIMENTS

Figure 1A:
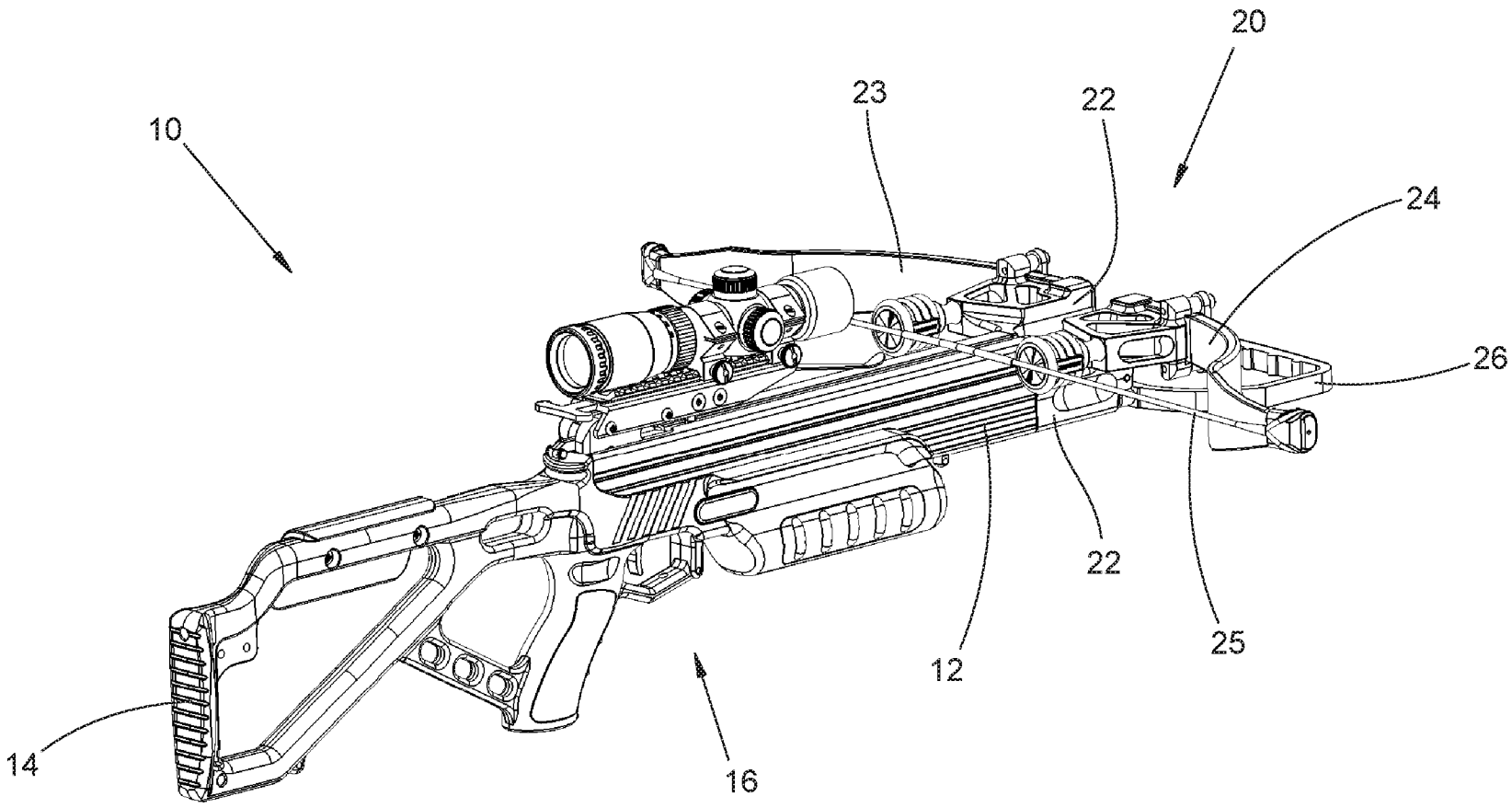
FIGS. 1A and 1B are oblique views of an example inventive crossbow in an assembled arrangement.
Figure 1B:
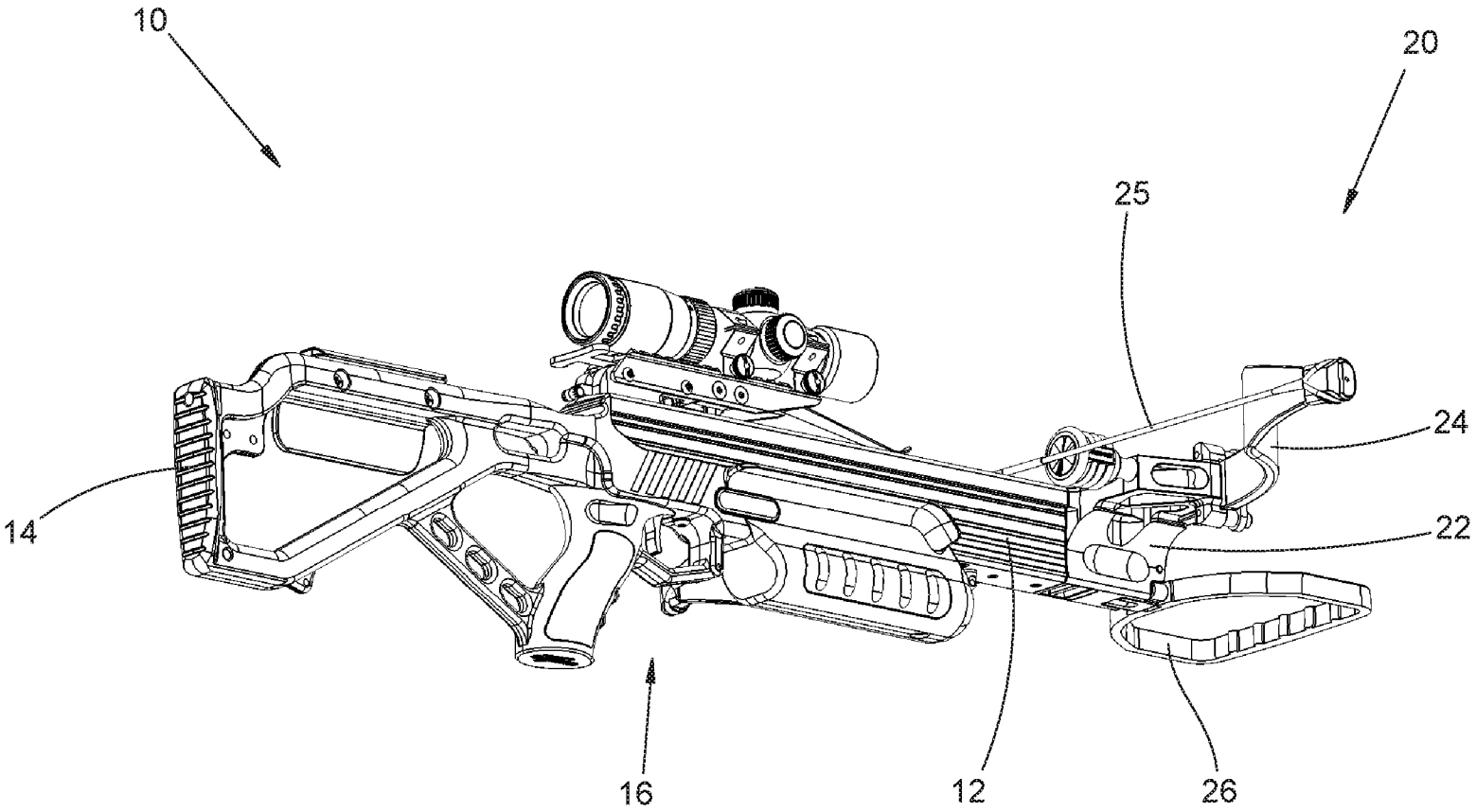
Figure 5B:
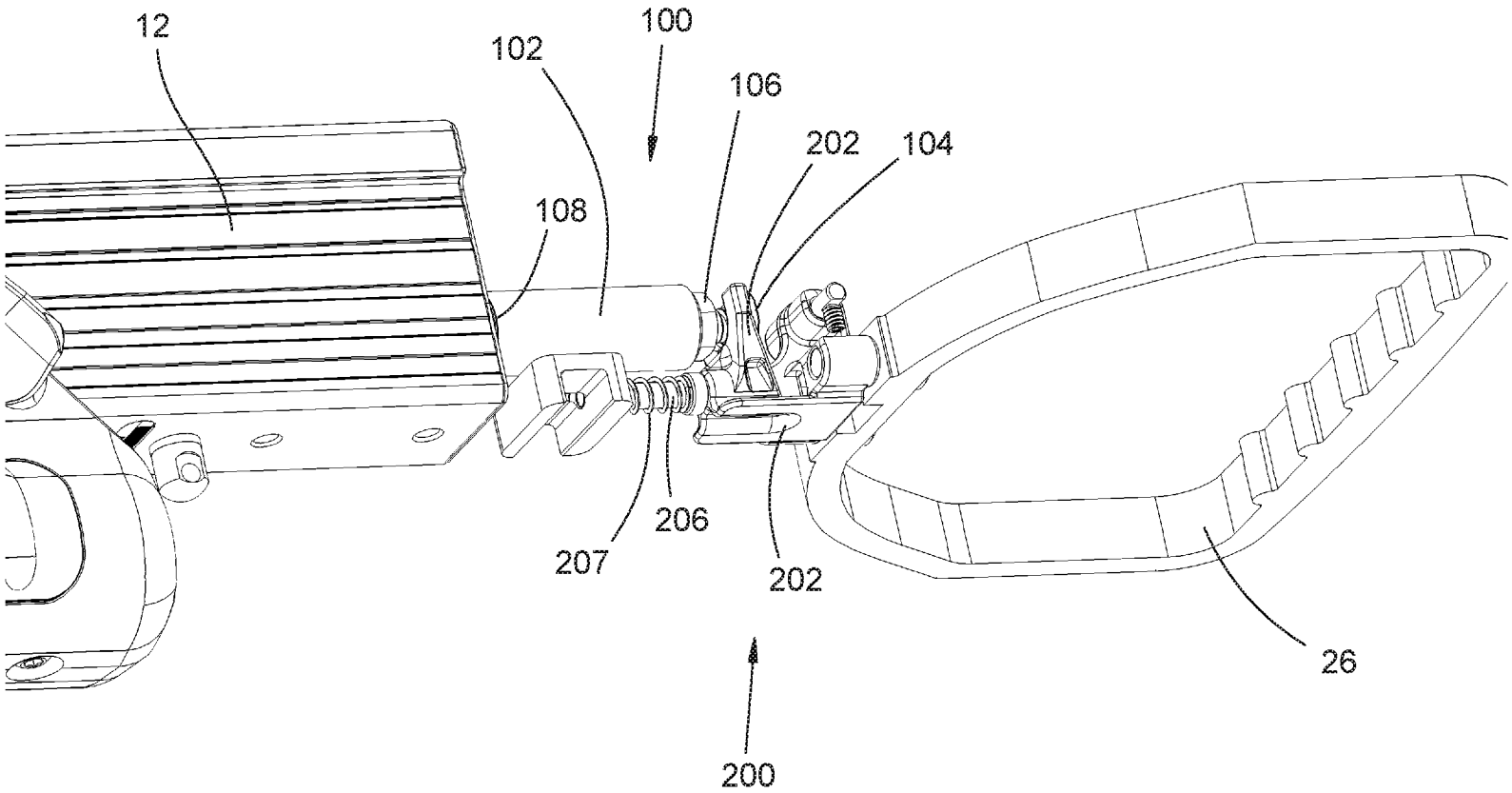
FIGS. 5B and 5C are oblique views, with the riser and limbs omitted for clarity, of the example inventive crossbow in an assembled arrangement.
Figure 5C:
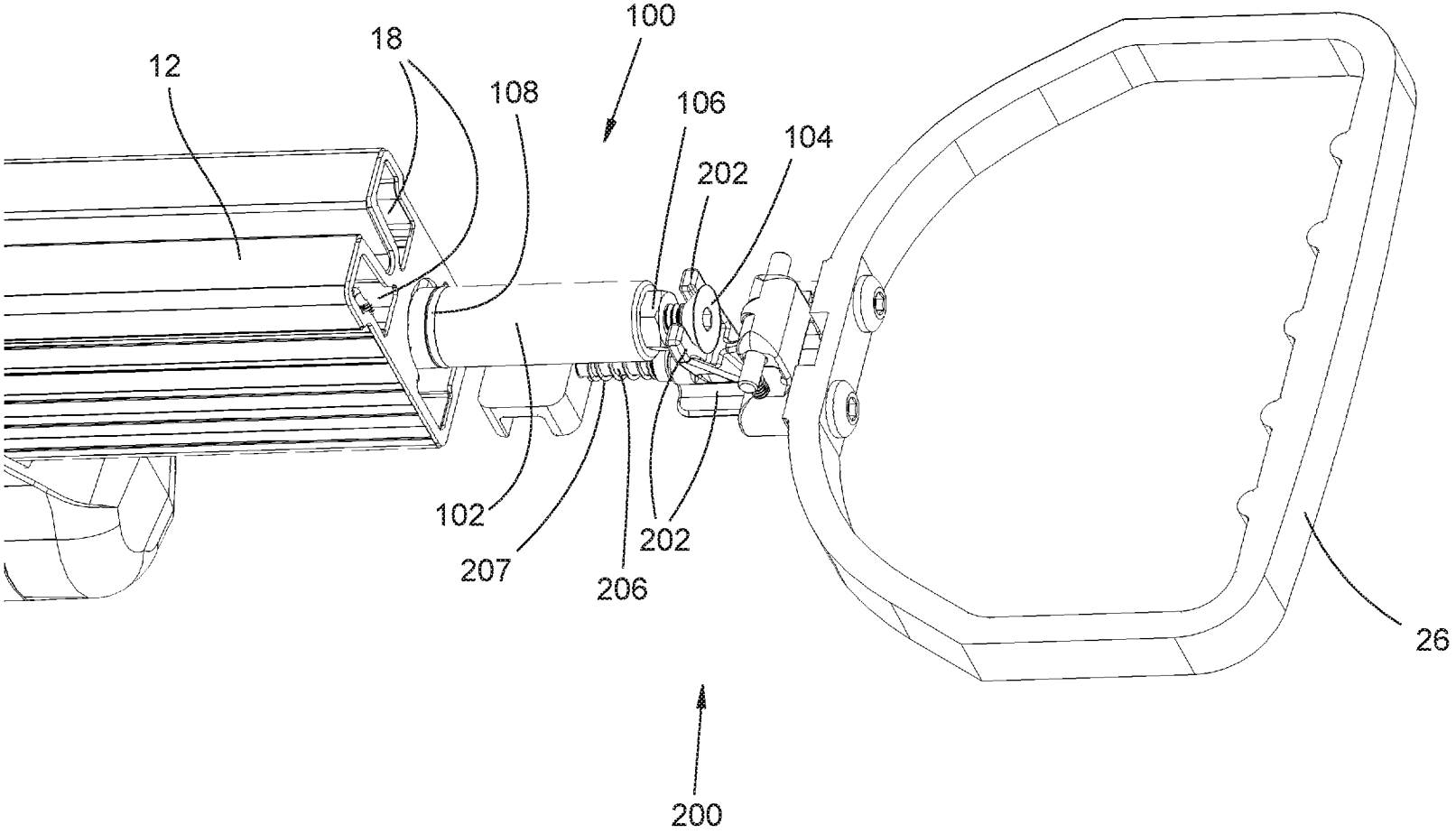
Figure 5D:
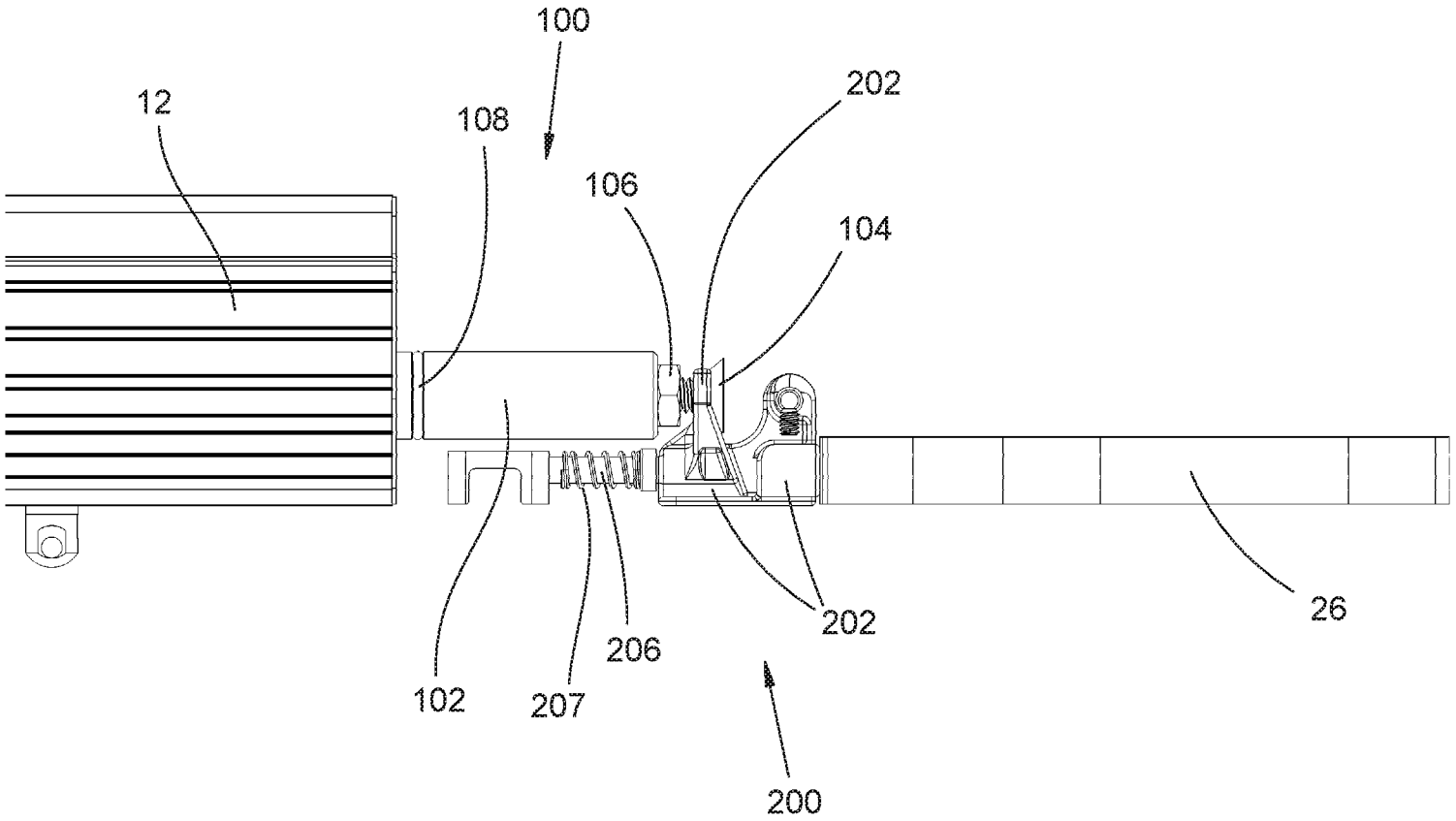
FIG. 5D is a side view, with the riser and limbs omitted for clarity, of the example inventive crossbow in the assembled arrangement.

An inventive crossbow comprises a rail assembly 10, a limb assembly 20, a retention member 200 movable between a retention position and a release position, and a release member 100. An example embodiment is shown assembled in FIGS. 1A/1B, 3B, 4B, and 5B/5C/5D, and is shown disassembled in FIGS. 2A/2B, 3A, 4A, and 5A. The rail assembly 10 includes a longitudinal rail 12, a rearward stock portion 14, and a trigger assembly 16. The limb assembly 20 includes a central riser 22 and a pair of bow limbs 23/24 attached to and extending transversely from opposite sides of the riser 22. Note that in FIGS. 3A/3B and 4A/4B the limbs 23/24 have been omitted for clarity, and that in FIGS. 5A/5B/5C/5D the riser 22 and the limbs 23/24 have been omitted for clarity. The riser 22, limbs 23/24, rail 12, stock 14, and trigger 16 can be of any suitable type or arrangement, formed from any suitable one or more materials (e.g., metal, wood, polymer, composite, and so forth). The example shown is a recurve crossbow with a bowstring 25 connected directly to the ends of the limbs 23/24. A crossbow with a detachable limb assembly 10 can be readily implemented with a recurve crossbow, in which typically there is no need for the bowstring 25 to be constrained in a slide that moves along the rail 12. A detachable limb assembly 10 is more problematic to implement in a compound crossbow, in which the bowstring 25 or one or more other cables are constrained by a slide that moves along the rail and complicates removal of the limb assembly 20 from the rail assembly 10. Nevertheless, crossbows disclosed or claimed herein can include any type of crossbow, including recurve and compound crossbows.

In the example shown, the release member 100 is substantially rigidly attached to and extends forward from a forward portion of the rail 12, while the retention member 200 is attached to the riser 22. In other examples (not shown), the release member 100 can be substantially rigidly attached to and extend rearward from the riser 22, while the retention member 200 is attached to a forward portion of the rail 12. When the crossbow is assembled with the riser and limb assemblies 10/20 in an assembled arrangement, the release member 100 is in a retained position and the riser 22 is positioned against the forward portion of the rail 12 (e.g., as in FIGS. 1A/1B, 3B, 4B, and 5B/5C/5D). When the crossbow is disassembled, the rail and limb assemblies 10/20 are separated from one another (i.e., are moved to a disassembled arrangement; e.g., as in FIGS. 2A/2B, 3A, 4A, and 5A), and the release member 100 is removed from the retained position. With the retention member 200 in the release position (e.g., as in FIGS. 2A/2B, 3A, 4A, and 5A), the release member 100 is movable into the retained position and removable from the retained position, thereby enabling assembly and disassembly, respectively, of the crossbow.

With the release member 100 in the retained position and the retention member 200 in the retention position (e.g., as in FIGS. 1A/1B, 3B, 4B, and 5B/5C/5D), engagement of the retention member 200 and the release member 100 prevents removal of the release member 100 from the retained position, thereby also preventing separation of the rail and limb assemblies 10/20 and disassembly of the crossbow. Engagement of the retention member 200 and the release member 100 also urges the riser 22 and the forward portion of the rail 12 against each other, so that the assembled rail and limb assemblies 10/20 are held together substantially rigidly. With the release member 100 in the retained position and the rail and limb assemblies 10/20 of the crossbow in the assembled arrangement, the retention member 200 is movable between the release and retention positions without using any tool. The release and retention members 100/200 therefore provide so-called quick-connect and quick-disconnect functionality for assembly and disassembly, respectively, of the crossbow.

One or both of the release member 100 or the retention member 200 are arranged so as to enable adjustment of the force that urges against each other the riser 22 and the forward portion of the rail 12. That force is large enough to hold together the assembled rail and limb assemblies 10/20. Because the crossbow typically is assembled and then disassembled each time it is taken out for use and then put away after use, the force exerted by engagement of the release and retention members 100/200 can lead to significant wear of one or both of those components, potentially diminishing the force holding together the rail and limb assemblies 10/20 and even permitting undesirable relative movement of those assemblies. The adjustable arrangement of the release member 100 and/or retention member 200 enables compensation for the wear that may occur, so that the assembled crossbow can be securely assembled together despite that wear.

The release and retention members 100/200 can be of any suitable type or arrangement, and can be formed from any suitable one or more materials that are sufficiently rigid and strong; metal parts are often employed. In the example shown, the retention member 200 comprises a forked latch 202 rotatable between the retention and release positions, while the release member 100 includes a widened head portion at its forward end and a narrowed neck portion connecting the head portion to a remainder of the release member 100. More specifically, in the example shown, the release member 100 comprises a substantially rigid elongated rod 102 substantially rigidly attached to and extending forward from the forward portion of the rail 12, a screw 104 threadedly engaged in a hole in a forward end of the rod 102 and extending forward from the forward end of the rod 102, and a jam nut 106 threadedly engaged on the screw 104 so as to enable locking of the threadedly engaged screw 104. With the release member 100 (i.e., rod 102 and screw 104) in the retained position and the retention member 200 (i.e., the forked latch 202) in the retention position, the narrowed neck portion (i.e., the shaft of the screw 104) passes between forks of the forked latch 202 and the widened head portion (i.e., the head of the screw 104) prevents removal of the release member 100 from the retained position between the forks. The head of the screw 104 is rearwardly tapered; with the release member 100 in the retained position and the retention member in the retention position, the tapered portion of screw 104 engages the forks of the forked latch 202 so as to urge against each other the riser 22 and the forward portion of the rail 12. The tapered portion of the screw 104 provides wedge-like engagement of the release and retention members 100/200. To adjust the force urging together those members, the jam nut 106 is loosened, the screw 104 turned to move it longitudinally to a desired position, and the jam nut 106 retightened to lock the threadedly engaged screw 104 in place. In some examples (not shown), the rod 102 can be omitted, and the screw 104 can be threadedly engaged in a threaded hole in the front portion of the rail 12.

In some examples, including the example shown, the limb assembly 20 further includes a stirrup 26 attached to the riser 22 and movable between a draw position (e.g., as in FIGS.

Figure 2A:
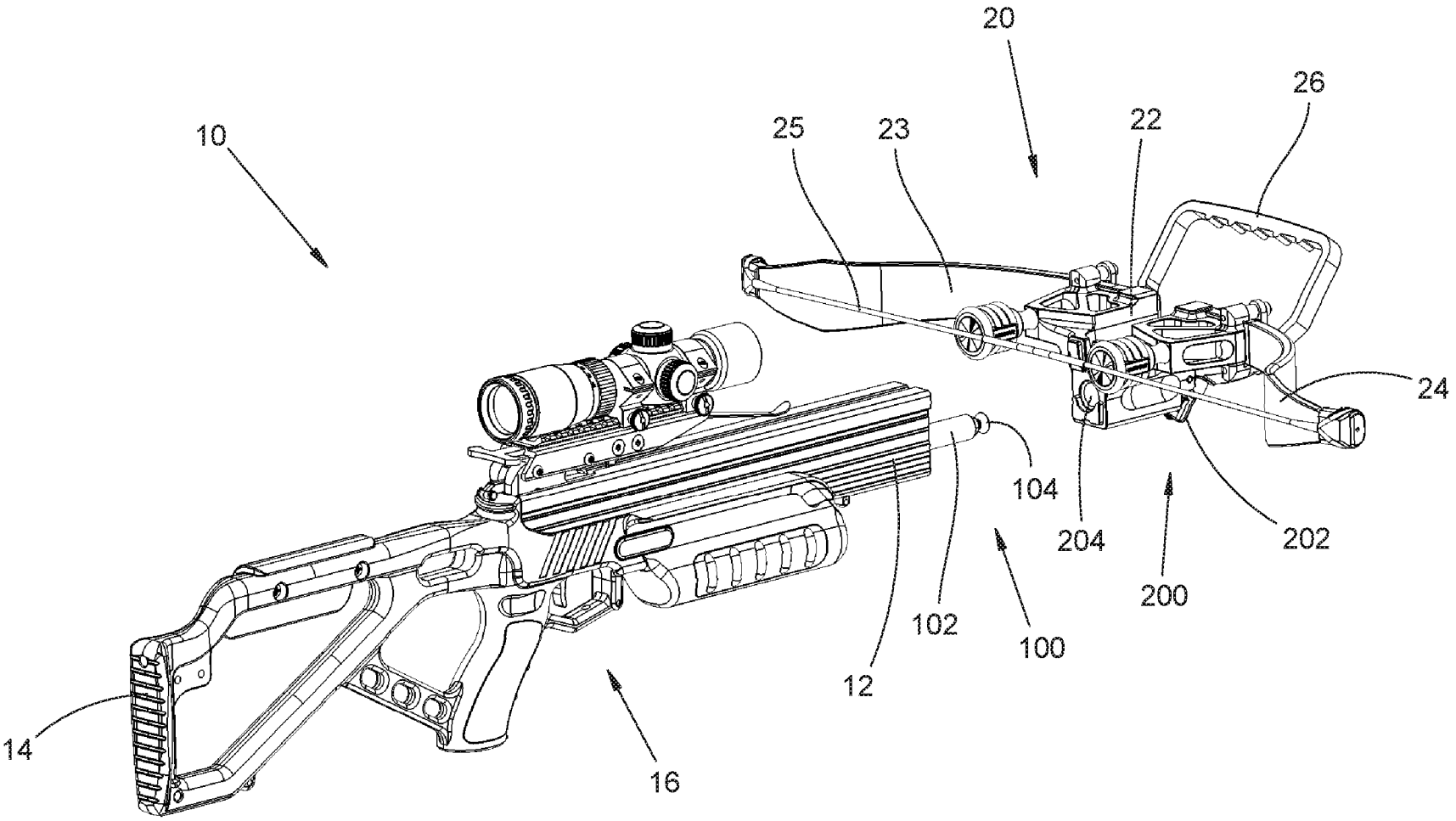
FIGS. 2A and 2B are oblique views of an example inventive crossbow in a disassembled arrangement.
Figure 2B:
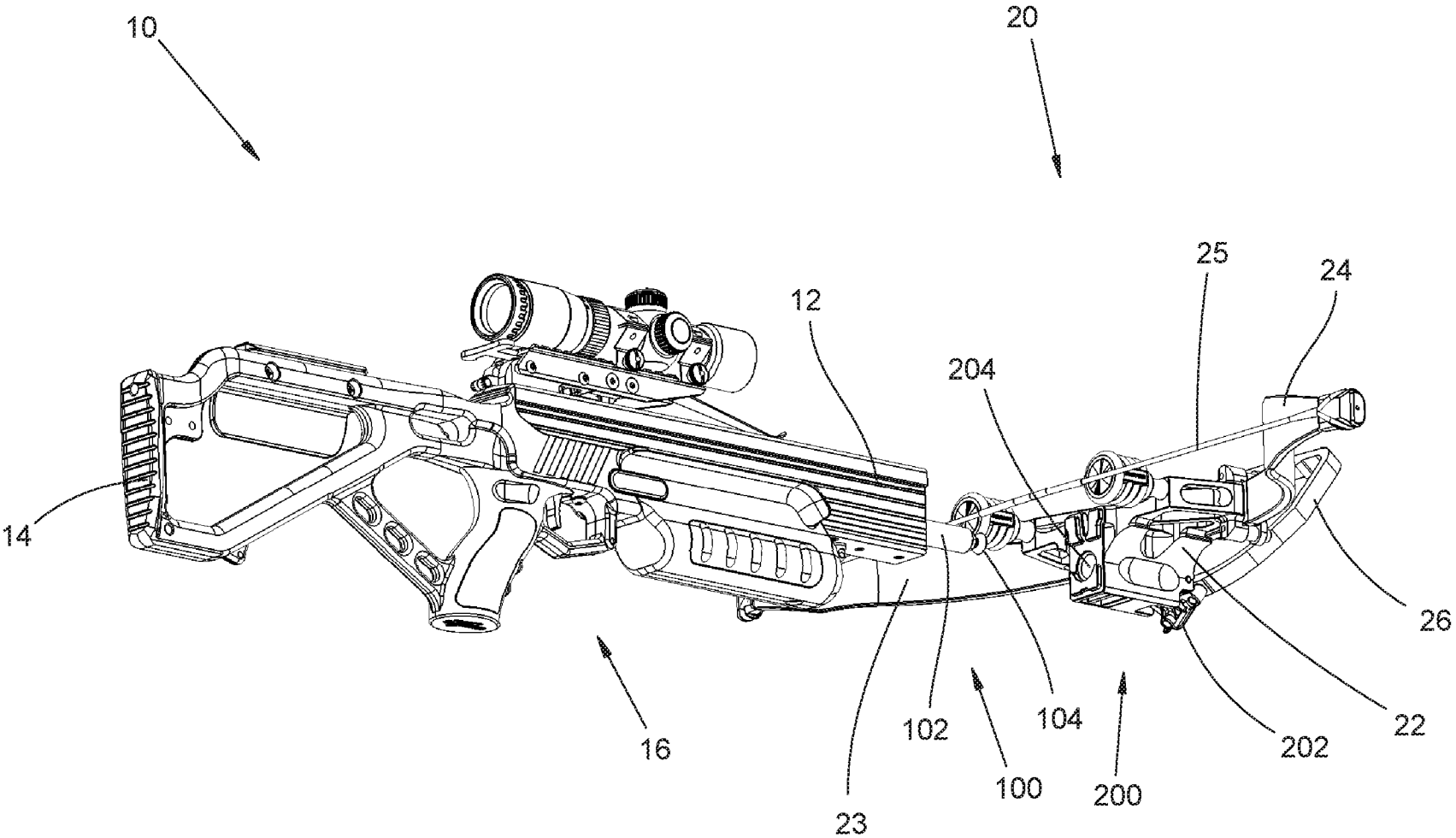
Figure 3A:
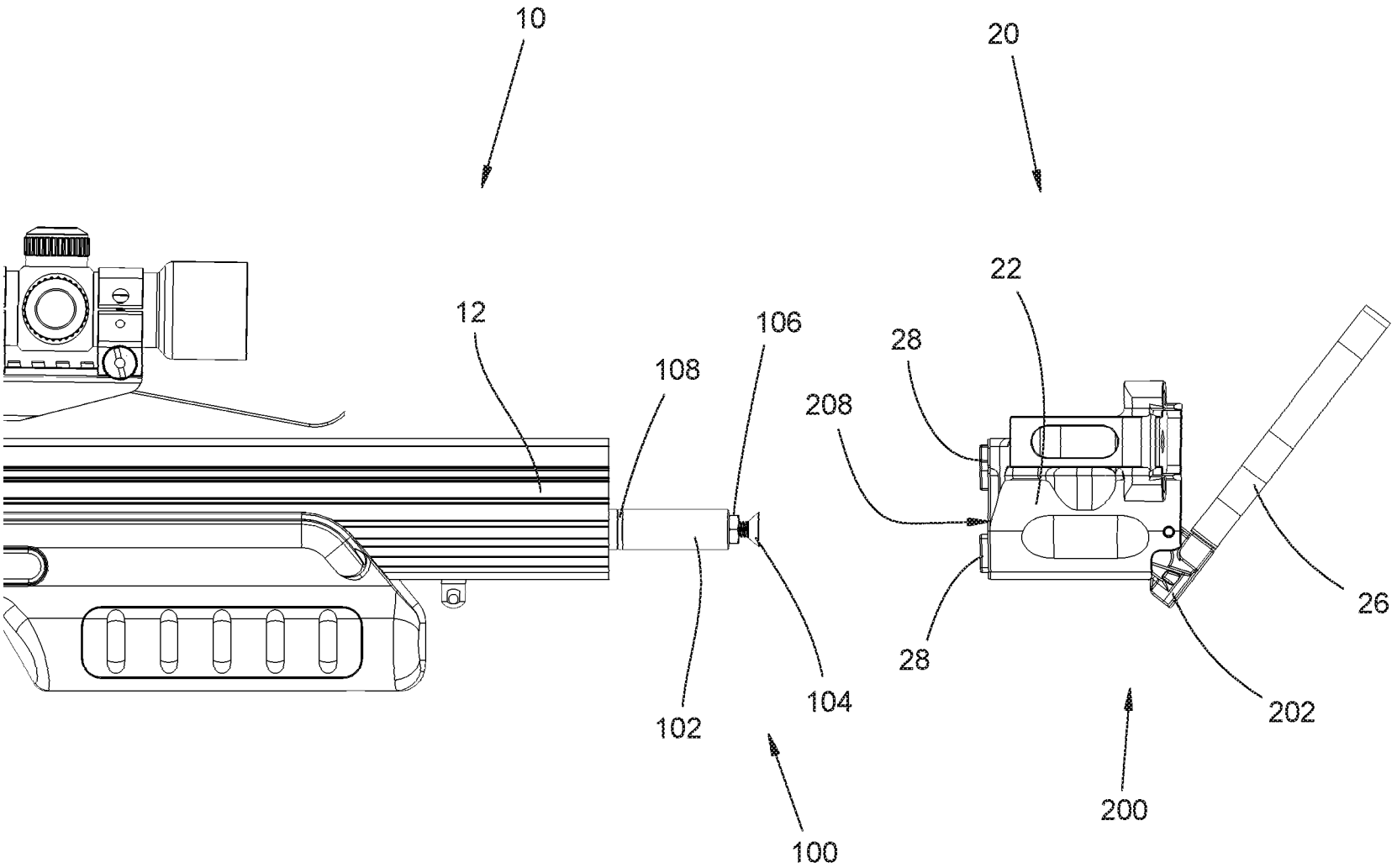
FIGS. 3A and 3B are side views, with the limbs omitted for clarity, of an example inventive crossbow in disassembled and assembled arrangements, respectively.
Figure 3B:
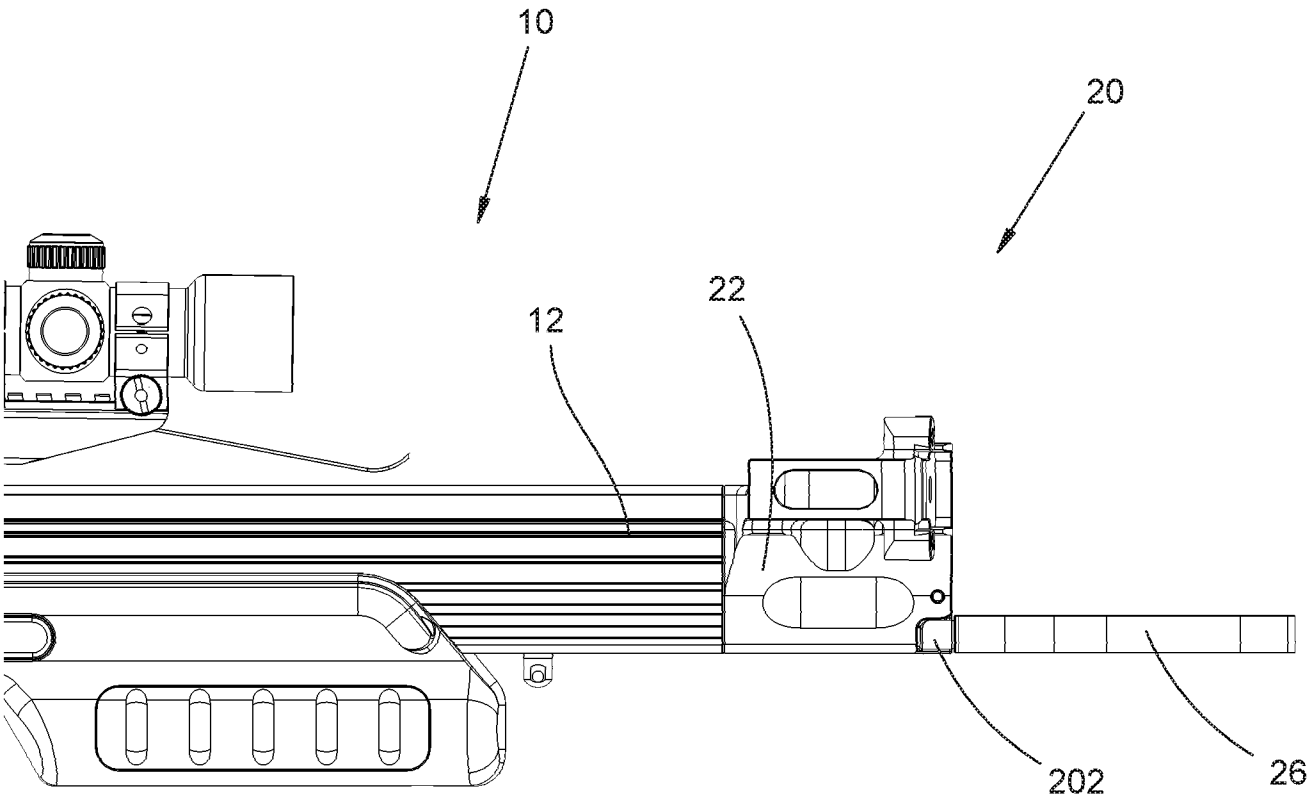
Figure 4A:
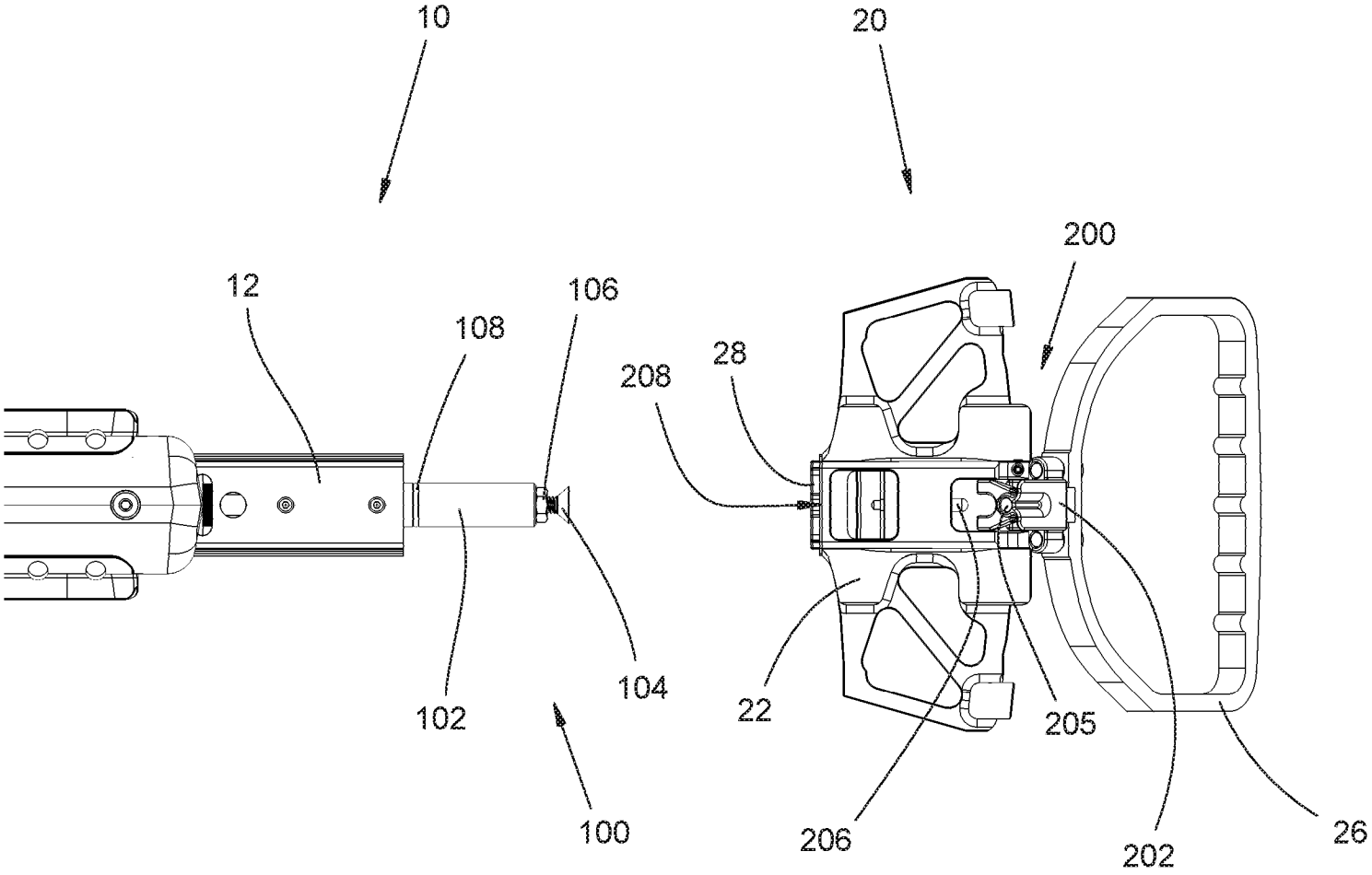
FIGS. 4A and 4B are bottom views, with the limbs omitted for clarity, of an example inventive crossbow in disassembled and assembled arrangements, respectively.
Figure 4B:
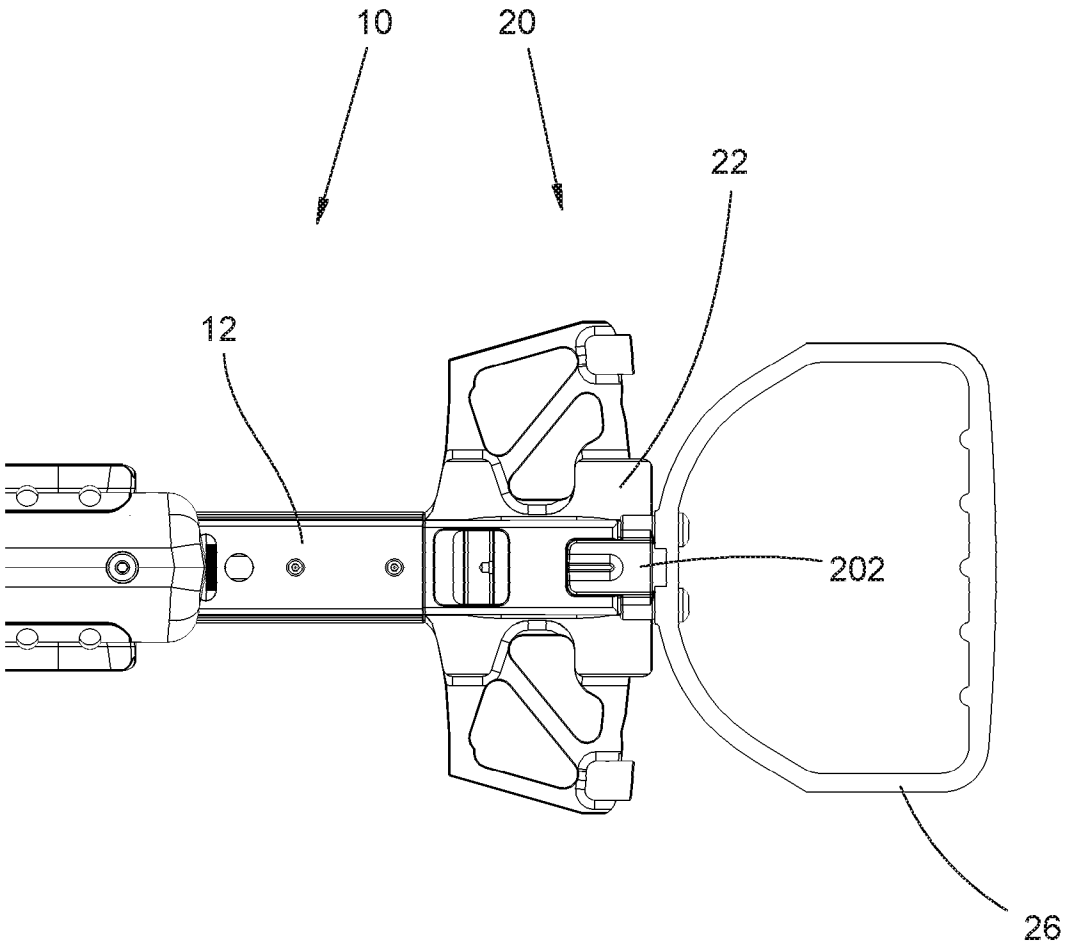

1A/1B, 3B, 4B, and 5B/5C/5D) and a disassembly position (e.g., as in FIGS. 2A/2B, 3A, 4A, and 5A). In the draw position, the stirrup 26 is suitably positioned for placement on the ground with the crossbow pointing downward so that the user can place his/her foot in the stirrup to hold down the crossbow as its bowstring 25 is drawn upward. In the example shown, the retention member 200 is substantially rigidly attached to the stirrup 26. With the stirrup 26 in the disassembly position the retention member 200 is in the release position, and with the stirrup 26 in the draw position the retention member 200 is in the retention position. The stirrup 26 and the retention member 200 are thereby structurally arranged so that movement of the stirrup 26 between draw and disassembly positions effects movement of the retention member 200 between the retention and release positions, respectively. The extra leverage provided by the stirrup 26 can assist the user in moving the retention member 200 between the release and retention positions without using any tool.

In some examples, including the example shown, the crossbow can further comprise a locking member attached to the riser 22 and movable between a locked position and an unlocked position. In the example shown, the locking member is a reciprocating shaft 206 attached to the riser 22 and biased toward the locking position by a spring 207, and the retention member 200 (the forked latch 202) includes a hole 205 for receiving therein a forward end of the shaft 206. With the locking member in the unlocked position (e.g., with the shaft 206 moved rearward against the bias of the spring 206), the retention member 200 (e.g., the latch 202) is movable between the release and retention positions. With the retention member 200 (e.g., the latch 202) in the retention position and the locking member (e.g., shaft 206) in the locked position (e.g., positioned with its forward end in the hole 205), engagement of the retention member 200 and the locking member prevents movement of the retention member 200 from the retention position to the release position.

In some examples, including the example shown, wherein the release member 100 includes the elongated rod 102, the riser can include a passage 204 arranged so that, with the release member 100 in the retained position, the release member 200 extends into the passage 204 in the riser 22. Such examples can further comprise one or more plastic or elastic gaskets, seals, or O-rings (O-ring 108 in the example shown). The one or more gaskets, seals, or O-rings are positioned, with the release member 100 in the retained position, between and in contact with the rod 102 and an interior surface of the passage 204. The plastic or elastic nature of the gasket, seal, or O-ring can facilitate insertion or removal of the rod 102 from the passage 204 during assembly or disassembly of the crossbow, and can also provide damping or suppression of noise or vibration during use of the crossbow or during assembly or disassembly of the crossbow. Similarly, one or more plastic or elastic gaskets, seals, or O-rings (gasket 208 in the example shown) can be positioned, with the crossbow in the assembled arrangement, between and in contact with the riser 22 and the forward portion of the rail 12, and can provide damping or suppression of noise or vibration during use of the crossbow or during assembly or disassembly of the crossbow. Any suitable plastic or elastic material can be employed for the gasket(s), seal(s), or O-rings(s).

In some examples, including the example shown, the riser 22 and the front portion of the rail 12 include mating alignment structures positioned and arranged so as to engage each other when the limb and riser assemblies 10/20 are in the assembled arrangement. In the example shown, the riser 22 includes raised areas 28 that mate with corresponding recessed areas 18 on the front portion of the rail 12. Other types or arrangements of alignment structures can be employed, e.g., tabs/sots, holes/pins, and so forth.

To assemble the crossbow, the riser 22 is first positioned against the forward portion of the rail 12, with the retention member 200 in the release position, so that (i) the release member 100 is in the retained position and (ii) the rail and limb assemblies 10/20 are in the assembled arrangement, thereby assembling the crossbow. Then, with the release member 100 in the retained position, the retention member 200 is moved from the release position to the retention position, thereby (i) urging the riser 22 and the forward portion of the rail 12 against each other and (ii) preventing removal of the release member 100 from the retained position and disassembly of the crossbow. If a locking member is present, it is moved to the unlocked position and held there before moving the retention member 200 to the retention position, and then moved to the locked position to prevent movement of the retention member 200 from the retention position to the release position.

To disassemble the crossbow, the retention member 200 is moved, with the rail and limb assemblies in the assembled arrangement and the release member 100 in the retained position, from the retention position to the release position, thereby enabling removal of the release member 100 from the retained position and disassembly of the crossbow. Then, with the retention member 200 in the release position, the riser 22 is separated from the rail 12 so that (i) the release member 100 is removed from the retained position and (ii) the rail and limb assemblies 10/20 are in the disassembled arrangement, thereby disassembling the crossbow. If a locking member s present, it is moved to the unlocked position and held there before moving the retention member 200 to the release position.

To adjust the force urging together the riser 22 and the front portion of the rail 12, the crossbow is first disassembled as described above. With the crossbow disassembled, one or both of the release member 100 or the retention member 200 are adjusted, thereby altering the force with which engagement of the retention member 200 and the release member 100 urges against each other the riser 22 and the forward portion of the rail 12. In the example shown, the adjustment is done by loosening the jam nut 106, rotating the screw 104, and retightening the jam nut 106. After the adjustment, the crossbow is then reassembled as described above.

In addition to the preceding, the following examples fall within the scope of the present disclosure or appended claims:

Example 1

A crossbow comprising a rail assembly, a limb assembly, a retention member movable between a retention position and a release position, and a release member, wherein: (a) the rail assembly includes a longitudinal rail and a rearward stock portion, and the limb assembly includes a central riser and a pair of bow limbs attached to and extending transversely from opposite sides of the riser; (b) either (i) the release member is substantially rigidly attached to and extends forward from a forward portion of the rail and the retention member is attached to the riser, or (ii) the release member is substantially rigidly attached to and extends rearward from the riser and the retention member is attached to a forward portion of the rail; (c) with the release member in a retained position, the riser is positioned against the forward portion of the rail so that the rail and limb assemblies of the crossbow are in an assembled arrangement, and with the release member removed from the retained position, the riser is separated from the rail so that the rail and limb assemblies of the crossbow are in a disassembled arrangement; (d) with the retention member in the release position, the release member is movable into the retained position and removable from the retained position, thereby enabling assembly and disassembly, respectively, of the crossbow; (e) with the release member in the retained position and the retention member in the retention position, engagement of the retention member and the release member (i) prevents removal of the release member from the retained position thereby preventing disassembly of the crossbow, and (ii) urges the riser and the forward portion of the rail against each other; (f) one or both of the release member or the retention member are arranged so as to enable adjustment of force with which engagement of the retention member and the release member urges against each other the riser and the forward portion of the rail; and (g) with the release member in the retained position and the rail and limb assemblies of the crossbow in the assembled arrangement, the retention member is movable between the release and retention positions without using any tool.

Example 2

The crossbow of Example 1 wherein the release member is substantially rigidly attached to and extends forward from a forward portion of the rail and the retention member is attached to the riser.

Example 3

The crossbow of Example 2 wherein (i) the retention member comprises a forked latch rotatable between the retention and release positions, (ii) the release member includes a widened head portion at its forward end and a narrowed neck portion connecting the head portion to a remainder of the release member, (iii) with the release member in the retained position and the retention member in the retention position, the narrowed neck portion passes between forks of the forked latch and the widened head portion prevents removal of the release member from the retained position between the forks.

Example 4

The crossbow of Example 3 wherein the widened head portion is rearwardly tapered and, with the release member in the retained position and the retention member in the retention position, engages the forks of the forked latch so as to urge against each other the riser and the forward portion of the rail.

Example 5

The crossbow of any one of Examples 3 or 4 wherein (i) the widened head portion is a head of a screw, (ii) the narrowed neck portion includes at least a portion of a threaded or unthreaded shank of the screw, (iii) the screw is threadedly engaged with a threaded hole in the release member or in the forward portion of the riser, and (iv) rotation of the threadedly engaged screw effects adjustment of the force with which engagement of the retention member and the release member urges against each other the riser and the forward portion of the rail.

Example 6

The crossbow of Example 5 wherein the release member further includes a jam nut threadedly engaged onto the screw so as to enable locking of the threadedly engaged screw.

Example 7

The crossbow of any one of Examples 5 or 6 wherein the release member includes a substantially rigid elongated rod substantially rigidly attached to and extending forward from the forward portion of the rail, and the screw is threadedly engaged in a threaded hole in the forward end of the rod and extends forward from the forward end of the rod.

Example 8

The crossbow of any one of Examples 5 or 6 wherein the screw is threadedly engaged in a threaded hole in the forward portion of the rail and extends forward from the forward portion of the rail.

Example 9

The crossbow of any one of Examples 2 through 8 wherein (i) the limb assembly further includes a stirrup attached to the riser and movable between a draw position and a disassembly position, (ii) the retention member is substantially rigidly attached to the stirrup, (iii) with the stirrup in the disassembly position the retention member is in the release position, (iv) with the stirrup in the draw position the retention member is in the retention position, and (v) the stirrup and the retention member are structurally arranged so that movement of the stirrup between draw and disassembly positions effects movement of the retention member between the retention and release positions, respectively.

Example 10

The crossbow of any one of Examples 2 through 9 further comprising a locking member attached to the riser and movable between a locked position and an unlocked position, wherein: (i) with the locking member in the unlocked position, the retention member is movable between the release and retention positions; and (ii) with the retention member in the retention position and the locking member in the locked position, engagement of the retention member and the locking member prevents movement of the retention member from the retention position to the release position.

Example 11

The crossbow of Example 10 wherein (i) the locking member comprises a reciprocating shaft and a bias member arranged to bias the reciprocating shaft toward the locked position, and (ii) the retention member includes a hole arranged so as to receive therein, with the reciprocating shaft in the locked position, a forward end of the reciprocating shaft.

Example 12

The crossbow of any one of Examples 2 through 11 wherein the release member includes an elongated rod arranged so that, with the release member in the retained position, the release member extends into a passage in the riser.

Example 13

The crossbow of Example 12 further comprising one or more plastic or elastic gaskets, seals, or O-rings that are positioned, with the release member in the retained position, between and in contact with the rod and an interior surface of the passage.

Example 14

The crossbow of any one of Examples 1 through 13 further comprising one or more plastic or elastic gaskets, seals, or O-rings positioned, with the crossbow in the assembled arrangement, between and in contact with the riser and the forward portion of the rail.

Example 15

The crossbow of any one of Examples 1 through 14 wherein the riser and the front portion of the rail include mating alignment structures positioned and arranged so as to engage each other when the limb and riser assemblies are in the assembled arrangement.

Example 16

A crossbow comprising a rail assembly, a limb assembly, a retention member movable between a retention position and a release position, a release member, and a locking member movable between a locked position and an unlocked position, wherein: (a) the rail assembly includes a longitudinal rail and a rearward stock portion, and the limb assembly includes a central riser, a pair of bow limbs attached to and extending transversely from opposite sides of the riser, and a stirrup attached to the riser and rotatable between a draw position and a disassembly position; (b) the retention member comprises a forked latch substantially rigidly attached to the stirrup so that (i) with the stirrup in the disassembly position the retention member is in the release position and (ii) with the stirrup in the draw position the retention member is in the retention position; (c) the locking member comprises a reciprocating shaft attached to the riser and biased toward the locked position so that (i) with the retention member in the retention position and the reciprocating shaft in the locked position, a forward end of the reciprocating shaft is positioned in a hole in the retention member thereby preventing movement of the retention member from the retention position to the release position, and (ii) with the reciprocating shaft in the unlocked position, the retention member is movable between the retention and release positions; (d) the release member comprises a substantially rigid elongated rod substantially rigidly attached to and extending forward from the forward portion of the rail, a screw threadedly engaged in a hole in a forward end of the rod and extending forward from the forward end of the rod, and a jam nut threadedly engaged on the screw so as to enable locking of the threadedly engaged screw; (e) with the release member in a retained position, the riser is positioned against the forward portion of the rail so that the rail and limb assemblies of the crossbow are in an assembled arrangement, and with the release member removed from the retained position, the riser is separated from the rail so that the rail and limb assemblies of the crossbow are in a disassembled arrangement; (f) with the retention member in the release position, the release member is movable into the retained position and removable from the retained position, thereby enabling assembly and disassembly, respectively, of the crossbow; (g) with the release member in the retained position and the retention member in the retention position, (i) a shank of the screw passes between forks of the forked latch and a head of the screw prevents removal of the screw from the retained position between the forks thereby preventing disassembly of the crossbow, and (ii) engagement of the head of the screw and the forks of the latch urges the riser and the forward portion of the rail against each other; (h) the forked latch and the screw are arranged so that rotation of the threadedly engaged screw alters force with which engagement of the head of the screw ad the forks of the latch urges against each other the riser and the forward portion of the rail; and (i) with the release member in the retained position and the rail and limb assemblies of the crossbow in the assembled arrangement, the retention member is movable between the release and retention positions without using any tool, by movement of the stirrup between the disassembly and draw positions, respectively.

Example 17

The crossbow of Example 16 wherein, with the release member in the retained position, the release member extends into a passage in the riser, and the crossbow further comprises one or more plastic or elastic gaskets, seals, or O-rings that are positioned, with the release member in the retained position, between and in contact with the rod and an interior surface of the passage.

Example 18

The crossbow of any one of Examples 16 or 17 further comprising one or more plastic or elastic gaskets, seals, or O-rings positioned, with the crossbow in the assembled arrangement, between and in contact with the riser and the forward portion of the rail.

Example 19

The crossbow of any one of Examples 16 through 18 wherein the riser and the front portion of the rail include mating alignment structures positioned and arranged so as to engage each other when the limb and riser assemblies are in the assembled arrangement.

Example 20

A method for using the crossbow of any one of Examples 16 through 19, the method comprising: (A) with the retention member in the retention position, moving the locking member from the locked position to the unlocked position; (B) after part (A), with the release member in the retained position and the locking member in the unlocked position, moving the stirrup from the draw position to the disassembly position without using any tool, thereby moving the retention member from the retention position to the release position and enabling removal of the release member from the retained position and disassembly of the crossbow; (C) after part (B), with the retention member in the release position, separating the riser from the rail so that (i) the release member is removed from the retained position and (ii) the rail and limb assemblies are in the disassembled arrangement, thereby disassembling the crossbow; (D) after part (C), with the limb and rail assemblies in the disassembled arrangement, (i) loosening the jam nut, (ii) rotating the screw, and (iii) retightening the jam nut, (iv) thereby altering the force with which engagement of the head of the screw and the forks of the latch urges against each other the riser and the forward portion of the rail; (E) after part (D), with the retention member in the release position, positioning the riser against the forward portion of the rail so that (i) the release member is in the retained position and (ii) the rail and limb assemblies are in the assembled arrangement, thereby assembling the crossbow; (F) after part (E), with the release member in the retained position and the locking member in the unlocked position, moving the stirrup from the disassembly position to the draw position without using any tool, thereby (i) moving the retention member from the release position to the retention position, (ii) urging the riser and the forward portion of the rail against each other, and (iii) preventing removal of the release member from the retained position and disassembly of the crossbow; and (G) after part (F), with the release member in the retained position and the retention member in the retention position, moving the locking member from the unlocked position to the locked position.

Example 21

A method for using the crossbow of any one of Examples 1 through 19, the method comprising: (A) with the retention member in the release position, positioning the riser against the forward portion of the rail so that (i) the release member is in the retained position and (ii) the rail and limb assemblies are in the assembled arrangement, thereby assembling the crossbow; and (B) after part (A), with the release member in the retained position, moving the retention member from the release position to the retention position without using any tool, thereby (i) urging the riser and the forward portion of the rail against each other and (ii) preventing removal of the release member from the retained position and disassembly of the crossbow.

Example 22

A method for using the crossbow of any one of Examples 1 through 19, the method comprising: (A) with the release member in the retained position, moving the retention member from the retention position to the release position without using any tool, thereby enabling removal of the release member from the retained position and disassembly of the crossbow; and (B) after part (A), with the retention member in the release position, separating the riser from the rail so that (i) the release member is removed from the retained position and (ii) the rail and limb assemblies are in the disassembled arrangement, thereby disassembling the crossbow.

Example 23

A method for using the crossbow of any one of Examples 1 through 19, the method comprising: (A) with the release member in the retained position, moving the retention member from the retention position to the release position without using any tool, thereby enabling removal of the release member from the retained position and disassembly of the crossbow; (B) after part (A), with the retention member in the release position, separating the riser from the rail so that (i) the release member is removed from the retained position and (ii) the rail and limb assemblies are in the disassembled arrangement, thereby disassembling the crossbow; (C) after part (B), with the limb and rail assemblies in the disassembled arrangement, adjusting one or both of the release member or the retention member, thereby altering the force with which engagement of the retention member and the release member urges against each other the riser and the forward portion of the rail; (D) after part (C), with the retention member in the release position, positioning the riser against the forward portion of the rail so that (i) the release member is in the retained position and (ii) the rail and limb assemblies are in the assembled arrangement, thereby assembling the crossbow; and (E) after part (D), with the release member in the retained position, moving the retention member from the release position to the retention position without using any tool, thereby (i) urging the riser and the forward portion of the rail against each other and (ii) preventing removal of the release member from the retained position and disassembly of the crossbow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable set of one or more features—which features are shown, described, or claimed in the present application—including those sets that may not be explicitly disclosed herein. A "suitable" set of features includes only features that are neither incompatible nor mutually exclusive with respect to any other feature of the set. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the scope of the appended claims can, but does not necessarily, encompass the whole of the subject matter disclosed in the present application.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open-ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A crossbow comprising a rail assembly, a limb assembly, a retention member movable between a retention position and a release position, and a release member, wherein:

(A) the rail assembly includes a longitudinal rail and a rearward stock portion, and the limb assembly includes a central riser and a pair of bow limbs attached to and extending transversely from opposite sides of the riser;

(B) the release member is substantially rigidly attached to and extends forward from a forward portion of the rail and the retention member is attached to the riser;

(C) with the release member in a retained position, the riser is positioned against the forward portion of the rail so that the rail and limb assemblies of the crossbow are in an assembled arrangement, and with the release member removed from the retained position, the riser is separated from the rail so that the rail and limb assemblies of the crossbow are in a disassembled arrangement;

(D) with the retention member in the release position, the release member is movable into the retained position and removable from the retained position, thereby enabling assembly and disassembly, respectively, of the crossbow;

(E) with the release member in the retained position and the retention member in the retention position, engagement of the retention member and the release member (i) prevents removal of the release member from the retained position thereby preventing disassembly of the crossbow, and (ii) urges the riser and the forward portion of the rail against each other;

(F) one or both of the release member or the retention member are arranged so as to enable adjustment of force with which engagement of the retention member and the release member urges against each other the riser and the forward portion of the rail;

(G) with the release member in the retained position and the rail and limb assemblies of the crossbow in the assembled arrangement, the retention member is movable between the release and retention positions without using any tool;

(H) (i) the retention member comprises a forked latch rotatable between the retention and release positions, (ii) the release member includes a widened head portion at its forward end and a narrowed neck portion connecting the head portion to a remainder of the release member, (iii) with the release member in the retained position and the retention member in the retention position, the narrowed neck portion passes between forks of the forked latch and the widened head portion prevents removal of the release member from the retained position between the forks; and (I) (i) the widened head portion is a head of a screw, (ii) the narrowed neck portion includes at least a portion of a threaded or unthreaded shank of the screw, (iii) the screw is threadedly engaged with a threaded hole in the release member or in the forward portion of the riser, and (iv) rotation of the threadedly engaged screw effects adjustment of the force with which engagement of the retention member and the release member urges against each other the riser and the forward portion of the rail.

2. The crossbow of claim 1 wherein the widened head portion is rearwardly tapered and, with the release member in the retained position and the retention member in the retention position, engages the forks of the forked latch so as to urge against each other the riser and the forward portion of the rail.

3. The crossbow of claim 1 wherein the release member further includes a jam nut threadedly engaged onto the screw so as to enable locking of the threadedly engaged screw.

4. The crossbow of claim 1 wherein the release member includes a substantially rigid elongated rod substantially rigidly attached to and extending forward from the forward portion of the rail, and the screw is threadedly engaged in a threaded hole in the forward end of the rod and extends forward from the forward end of the rod.

5. The crossbow of claim 1 wherein the screw is threadedly engaged in a threaded hole in the forward portion of the rail and extends forward from the forward portion of the rail.

6. The crossbow of claim 1 wherein (i) the limb assembly further includes a stirrup attached to the riser and movable between a draw position and a disassembly position, (ii) the retention member is substantially rigidly attached to the stirrup, (iii) with the stirrup in the disassembly position the retention member is in the release position, (iv) with the stirrup in the draw position the retention member is in the retention position, and (v) the stirrup and the retention member are structurally arranged so that movement of the stirrup between draw and disassembly positions effects movement of the retention member between the retention and release positions, respectively.

7. The crossbow of claim 1 further comprising a locking member attached to the riser and movable between a locked position and an unlocked position, wherein:

(i) with the locking member in the unlocked position, the retention member is movable between the release and retention positions; and (ii) with the retention member in the retention position and the locking member in the locked position, engagement of the retention member and the locking member prevents movement of the retention member from the retention position to the release position.

8. The crossbow of claim 7 wherein (i) the locking member comprises a reciprocating shaft and a bias member arranged to bias the reciprocating shaft toward the locked position, and (ii) the retention member includes a hole arranged so as to receive therein, with the reciprocating shaft in the locked position, a forward end of the reciprocating shaft.

9. The crossbow of claim 1 wherein the release member includes an elongated rod arranged so that, with the release member in the retained position, the release member extends into a passage in the riser.

10. The crossbow of claim 9 further comprising one or more plastic or elastic gaskets, seals, or O-rings that are positioned, with the release member in the retained position, between and in contact with the rod and an interior surface of the passage.

11. The crossbow of claim 1 further comprising one or more plastic or elastic gaskets, seals, or O-rings positioned, with the crossbow in the assembled arrangement, between and in contact with the riser and the forward portion of the rail.

12. The crossbow of claim 1 wherein the riser and the front portion of the rail include mating alignment structures positioned and arranged so as to engage each other when the limb and riser assemblies are in the assembled arrangement.

13. A method for using the crossbow of claim 1, the method comprising:

(a) with the retention member in the release position, positioning the riser against the forward portion of the rail so that (i) the release member is in the retained position and (ii) the rail and limb assemblies are in the assembled arrangement, thereby assembling the crossbow; and (b) after part (a), with the release member in the retained position, moving the retention member from the release position to the retention position without using any tool, thereby (i) urging the riser and the forward portion of the rail against each other and (ii) preventing removal of the release member from the retained position and disassembly of the crossbow.

14. A method for using the crossbow of claim 1, the method comprising:

(a) with the release member in the retained position, moving the retention member from the retention position to the release position without using any tool, thereby enabling removal of the release member from the retained position and disassembly of the crossbow; and (b) after part (a), with the retention member in the release position, separating the riser from the rail so that (i) the release member is removed from the retained position and (ii) the rail and limb assemblies are in the disassembled arrangement, thereby disassembling the crossbow.

15. A method for using the crossbow of claim 1, the method comprising:

(a) with the release member in the retained position, moving the retention member from the retention position to the release position without using any tool, thereby enabling removal of the release member from the retained position and disassembly of the crossbow;

(b) after part (a), with the retention member in the release position, separating the riser from the rail so that (i) the release member is removed from the retained position and (ii) the rail and limb assemblies are in the disassembled arrangement, thereby disassembling the crossbow;

(c) after part (b), with the limb and rail assemblies in the disassembled arrangement, adjusting one or both of the release member or the retention member, thereby altering the force with which engagement of the retention member and the release member urges against each other the riser and the forward portion of the rail;

(d) after part (c), with the retention member in the release position, positioning the riser against the forward portion of the rail so that (i) the release member is in the retained position and (ii) the rail and limb assemblies are in the assembled arrangement, thereby assembling the crossbow; and (e) after part (d), with the release member in the retained position, moving the retention member from the release position to the retention position without using any tool, thereby (i) urging the riser and the forward portion of the rail against each other and (ii) preventing removal of the release member from the retained position and disassembly of the crossbow.

16. A crossbow comprising a rail assembly, a limb assembly, a retention member movable between a retention position and a release position, a release member, and a locking member movable between a locked position and an unlocked position, wherein:

(a) the rail assembly includes a longitudinal rail and a rearward stock portion, and the limb assembly includes a central riser, a pair of bow limbs attached to and extending transversely from opposite sides of the riser, and a stirrup attached to the riser and rotatable between a draw position and a disassembly position;

(b) the retention member comprises a forked latch substantially rigidly attached to the stirrup so that (i) with the stirrup in the disassembly position the retention member is in the release position and (ii) with the stirrup in the draw position the retention member is in the retention position;

(c) the locking member comprises a reciprocating shaft attached to the riser and biased toward the locked position so that (i) with the retention member in the retention position and the reciprocating shaft in the locked position, a forward end of the reciprocating shaft is positioned in a hole in the retention member thereby preventing movement of the retention member from the retention position to the release position, and (ii) with the reciprocating shaft in the unlocked position, the retention member is movable between the retention and release positions;

(d) the release member comprises a substantially rigid elongated rod substantially rigidly attached to and extending forward from the forward portion of the rail, a screw threadedly engaged in a hole in a forward end of the rod and extending forward from the forward end of the rod, and a jam nut threadedly engaged on the screw so as to enable locking of the threadedly engaged screw;

(e) with the release member in a retained position, the riser is positioned against the forward portion of the rail so that the rail and limb assemblies of the crossbow are in an assembled arrangement, and with the release member removed from the retained position, the riser is separated from the rail so that the rail and limb assemblies of the crossbow are in a disassembled arrangement;

(f) with the retention member in the release position, the release member is movable into the retained position and removable from the retained position, thereby enabling assembly and disassembly, respectively, of the crossbow;

(g) with the release member in the retained position and the retention member in the retention position, (i) a shank of the screw passes between forks of the forked latch and a head of the screw prevents removal of the screw from the retained position between the forks thereby preventing disassembly of the crossbow, and (ii) engagement of the head of the screw and the forks of the latch urges the riser and the forward portion of the rail against each other;

(h) the forked latch and the screw are arranged so that rotation of the threadedly engaged screw alters force with which engagement of the head of the screw ad the forks of the latch urges against each other the riser and the forward portion of the rail; and (i) with the release member in the retained position and the rail and limb assemblies of the crossbow in the assembled arrangement, the retention member is movable between the release and retention positions without using any tool, by movement of the stirrup between the disassembly and draw positions, respectively.

17. The crossbow of claim 16 wherein, with the release member in the retained position, the release member extends into a passage in the riser, and the crossbow further comprises one or more plastic or elastic gaskets, seals, or O-rings that are positioned, with the release member in the retained position, between and in contact with the rod and an interior surface of the passage.

18. The crossbow of claim 16 further comprising one or more plastic or elastic gaskets, seals, or O-rings positioned, with the crossbow in the assembled arrangement, between and in contact with the riser and the forward portion of the rail.

19. A method for using the crossbow of claim 16, the method comprising:

(A) with the retention member in the retention position, moving the locking member from the locked position to the unlocked position;

(B) after part (A), with the release member in the retained position and the locking member in the unlocked position, moving the stirrup from the draw position to the disassembly position without using any tool, thereby moving the retention member from the retention position to the release position and enabling removal of the release member from the retained position and disassembly of the crossbow;

(C) after part (B), with the retention member in the release position, separating the riser from the rail so that (i) the release member is removed from the retained position and (ii) the rail and limb assemblies are in the disassembled arrangement, thereby disassembling the crossbow;

(D) after part (C), with the limb and rail assemblies in the disassembled arrangement, (i) loosening the jam nut, (ii) rotating the screw, and (iii) retightening the jam nut, (iv) thereby altering the force with which engagement of the head of the screw and the forks of the latch urges against each other the riser and the forward portion of the rail;

(E) after part (D), with the retention member in the release position, positioning the riser against the forward portion of the rail so that (i) the release member is in the retained position and (ii) the rail and limb assemblies are in the assembled arrangement, thereby assembling the crossbow;

(F) after part (E), with the release member in the retained position and the locking member in the unlocked position, moving the stirrup from the disassembly position to the draw position without using any tool, thereby (i) moving the retention member from the release position to the retention position, (ii) urging the riser and the forward portion of the rail against each other, and (iii) preventing removal of the release member from the retained position and disassembly of the crossbow; and (G) after part (F), with the release member in the retained position and the retention member in the retention position, moving the locking member from the unlocked position to the locked position.

20. A method for using the crossbow of claim 16, the method comprising:

(A) with the retention member in the release position, positioning the riser against the forward portion of the rail so that (i) the release member is in the retained position and (ii) the rail and limb assemblies are in the assembled arrangement, thereby assembling the crossbow;

(B) after part (A), with the release member in the retained position, moving the retention member from the release position to the retention position without using any tool, thereby (i) urging the riser and the forward portion of the rail against each other and (ii) preventing removal of the release member from the retained position and disassembly of the crossbow; and (C) after part (B), with the release member in the retained position and the retention member in the retention position, moving the locking member from the unlocked position to the locked position.

21. A method for using the crossbow of claim 16, the method comprising:

(A) with the retention member in the retention position, moving the locking member from the locked position to the unlocked position;

(B) after part (A), with the release member in the retained position, moving the retention member from the retention position to the release position without using any tool, thereby enabling removal of the release member from the retained position and disassembly of the crossbow; and (C) after part (B), with the retention member in the release position, separating the riser from the rail so that (i) the release member is removed from the retained position and (ii) the rail and limb assemblies are in the disassembled arrangement, thereby disassembling the crossbow.

* * * * *